United States Patent [19]

Wilson

[11] 4,228,616

[45] Oct. 21, 1980

[54] FLYING SAUCER TOY

[76] Inventor: Donald C. Wilson, 18085 Birchcrest, Detroit, Mich. 48221

[21] Appl. No.: 973,222

[22] Filed: Dec. 26, 1978

Related U.S. Application Data

[63] Continuation-in-part of Ser. No. 894,198, Apr. 5, 1978.

[51] Int. Cl.[3] ..... A63H 33/26

[52] U.S. Cl. ..... 46/228; 46/201

[58] Field of Search ..... 46/228, 229, 230, 226, 46/227, 201, 206

[56] References Cited

U.S. PATENT DOCUMENTS

| | | | |
|---|---|---|---|
| 2,599,208 | 6/1952 | Starr | 46/228 X |
| 2,826,860 | 3/1958 | Ashley et al. | 46/206 X |
| 3,060,138 | 9/1961 | Tagliaferri | 46/228 X |
| 3,720,018 | 3/1973 | Peterson et al. | 46/228 |
| 3,812,614 | 5/1974 | Harrington | 46/74 D X |

*Primary Examiner*—Louis G. Mancene

*Assistant Examiner*—Mickey Yu

*Attorney, Agent, or Firm*—Basile, Weintraub & Hanlon

[57] ABSTRACT

A flying saucer toy made of translucent semi-rigid plastic material is disclosed. The toy has a cover with an outer rim extending horizontally around its periphery, a lower housing integral with the rim, which blends into an upper housing integral with the lower housing. The upper housing curves upward and inward in an arcuate manner to form a hemisphere closing the top. A plurality of arcuate openings around the periphery of the lower housing and a second plurality of arcuate openings around the periphery of the upper housing are covered by a colored transparent membrane. A flashing light in the interior of the saucer is powered by a battery power source. A flasher flashes the light bulb and an on/off switch interconnects the power source to the flasher and light bulb. A plurality of rotatable wheels attached to a bottom member allow the flying saucer toy to be moved about on the floor.

5 Claims, 2 Drawing Figures

FLYING SAUCER TOY

CROSS REFERENCE TO RELATED APPLICATIONS

This application is a continuation-in-part of a copending application Ser. No. 894,198 filed Apr. 5, 1978 entitled "FLYING SAUCER TOY".

BACKGROUND OF THE INVENTION

1. Field of the Invention

The present invention relates to the field of toys that are movable along the floor, and, in particular, to flying saucer type toys having battery powered internally flashing lights.

2. Prior Art Statement

Toys having wheels which allow them to be moved along a floor by a child have long been known. Flying saucer toys and toss toys resembling flying saucers have been known for some time as well. The applicant knows of no flying saucer toy having wheels mounted thereon for movement across the floor and having contained therein a battery powered flash light to improve the attractiveness of the toy. The above disclosure constitutes the entire prior art known to the applicant.

SUMMARY OF THE INVENTION

The present invention comprises a cover made from a semirigid translucent plastic sheet having an outer rim extending horizontally outward around its periphery, a lower housing integral with the rim curves upward and inward in an arcuate manner toward the center, terminating where the lower housing blends into an upper housing. The upper housing is integral with the lower housing and curves upward and inward in an arcuate manner to form a hemisphere closing the top. A plurality of arcuate openings are disposed around the upper periphery of the lower housing spaced down a distance from the upper housing. A second plurality of arcuate openings are disposed around the upper housing spaced up a predetermined distance from the lower housing. The first and second arcuate openings are covered with a colored transparent membrane.

A bottom member made from a semi-rigid translucent plastic sheet has a shape complimentray to the outer rim. A plurality of slots in the bottom member are configured to receive the projection of pairs of spaced apart wheels supported in a spaced apart manner by a pair of axles. The axles are supported by the bottom member by means of a pair of axle support members which are riveted to the bottom.

A circular slit concentric with the bottom member forms a circular cover. The slit ends short of a full circle to form a bridge of material from the cover to the bottom member which serves as a hinge. The cover has mounted thereto an on-off switch, a flasher base into which a bulb is inserted, a battery holder for holding two batteries, and means for attaching the switch, the flasher base, and the battery holder to the cover. The switch, the base, and the battery holder are interconnected by electrical wires forming an electrical circuit which allows the switch to selectively power the bulb. The flasher base causes the light bulb to flash on and off when the switch is in the on position. A rotatable cleat riveted to the bottom member near the cover in a rotatable manner opposite the hinge holds the cover closed.

A plurality of apertures in the rim are aligned with a plurality of apertures in the bottom member to receive a plurality of rivets which attach the bottom member to the rim.

The assembly of componets described hereinabove results in an attractive toy which children enjoy moving along the floor.

The objects, advantages, and applications, of the present invention will become apparent to those skilled in the art to which the present invention pertains when the accompanying description of one example of the best mode contemplated for practicing the invention is read in conjunction with the accompanying drawing.

BRIEF DESCRIPTION OF THE DRAWINGS

The description herein makes reference to the accompanying drawing wherein like numbers refer to like parts throughout the several views and wherein.

DESCRIPTION OF THE PREFERRED EMBODIMENT

Figure 1:
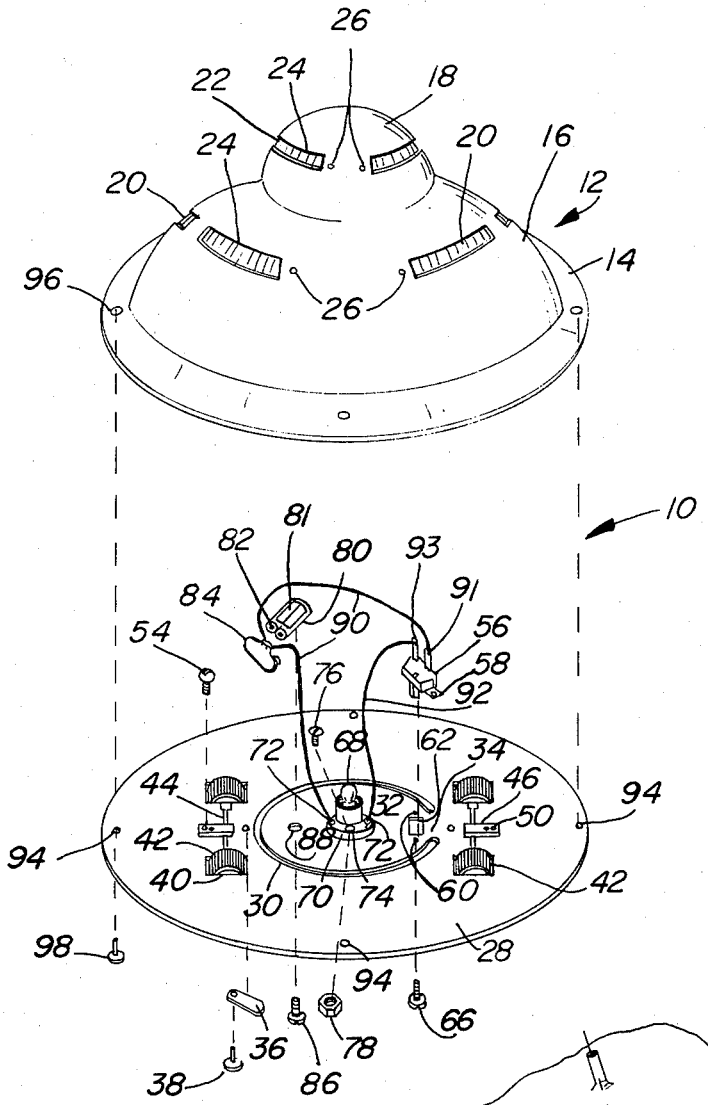
FIG. 1 illustrates an exploded view of the present invention.

Referring now to the drawing wherein there is illustrated an exploded view of the preferred embodiment of the present invention in the form of a toy 10. The toy 10 comprises a cover 12 made of semi-rigid translucent plastic sheet. The cover 12 has an outer rim 14 projecting horizontally outward a distance of approximately an inch around its periphery. The inner edge of the outer rim 14 is integral with a lower housing 16 which projects inward and upward toward the center in an arcuate manner terminating where it joins an upper housing 18. The upper housing 18 curves inward and upward forming a hemisphere to close the top of the cover 12. A first plurality of arcuate openings 20 are disposed around the upper periphery of the lower housing spaced down a distance from the upper housing 18. A second plurality of arcuate openings 22 are disposed around the periphery of the upper housing spaced up a distance from the lower housing 16. A colored transparent membrane 24 overlays and covers the first plurality 20 and second plurality 22 of arcuate openings. The colored translucent membrane 24 is held in place by a plurality of rivets 26.

A bottom member 28 made from semi-rigid translucent plastic sheet has a shape complimentary to the outer rim 14. A circular slit 30 spaced out from the center of the bottom member forms a cover 32. The slit 30 ends short of a full circle to form a hinge 34 to join the cover 32 to the bottom member 28. A pivotable cleat 36 is riveted to the bottom member 28 near the edge of the cover opposite the hinge 34 to selectively hold the cover closed. A plurality of parallel spaced apart openings 40 are disposed in the bottom member 28 to accommodate the projection of pairs of spaced apart wheels 42. The wheels 42 are supported in a spaced apart manner by an axle 44. An axle support member 46 has a half round slot along its bottom wall to slidingly surround the axle 40. A pair of apertures 50 in the axle support member 46 are aligned with a pair of apertures (not shown) in the bottom member 29. A pair of rivets 54 pass through the apertures 50 and the apertures in the cover to fixedly attach the axle support member 46 and the axle 44 and wheels 42 to the bottom member 28.

An opening 62 in the cover 32 is configured to slidingly receive the body of an on-off switch 56. A pair of apertures 58 in the flange of the switch 56 align with a pair of apertures 60 in the cover 32. A pair of threaded fasteners 66 pass through the apertures 60 and are threadingly received by the apertures 58 to affix the switch 56 to the cover 32.

A flasher light bulb socket 70 supports a light bulb 68. The flasher socket 70 has a pair of terminals 72 which innerconnect with the flasher device (not shown) and the light bulb 68. A pair of mounting apertures 74 in the base align with a pair of apertures (not shown) in the cover 32 to receive a pair of threaded fasteners 76. The fasteners 76 pass through the apertures 74 to receive a pair of threaded nuts 78 which fixedly attach the base 70 to the cover 32.

A battery holder 80 contains a pair of batteries 81 which comprise a power source. The batteries 81 are innerconnected to a pair of terminals 82 which receive a terminal connecter 84. An aperture 88 disposed in the cover 32 receives a threaded fastener 86 which threadingly engages a threaded aperture (not shown) in the bottom of the battery holder 80 to secure the battery holder 80 to the cover 32. The terminal receiver 84 engages the terminals 82 and has extending therefrom a pair of wire leads 90 which are interconnected at one end to the terminals 82. The other end of lead 90 extends to a terminal 72 of the base 70, the other end of the other lead 90 is innerconnected to a terminal 91 of the switch 56. The other terminal 93 of the switch 56 extends to the other lead terminal 72 of the base 70 to complete the electrical circuit. When the switch 56 is in the "off" position the circuit is open and no electrical current flows. When the switch 56 is moved to the "on" position, electrical current flows from the battery through the switch to the base and back to the battery causing the light 68 to become lighted. When the current has been on for a sufficient length of time the flasher device (not shown) in the base 70 begins to flash and cause the light 68 to go on and off.

A plurality of apertures 94 near the edge of the base 28 are aligned with a plurality of apertures 96 in the outer rim 14. A plurality of rivets 98 pass through the apertures 94 and 96 to fasten the bottom member 28 to the outer rim 14 and complete the assembly of the flying saucer toy.

Figure 2:
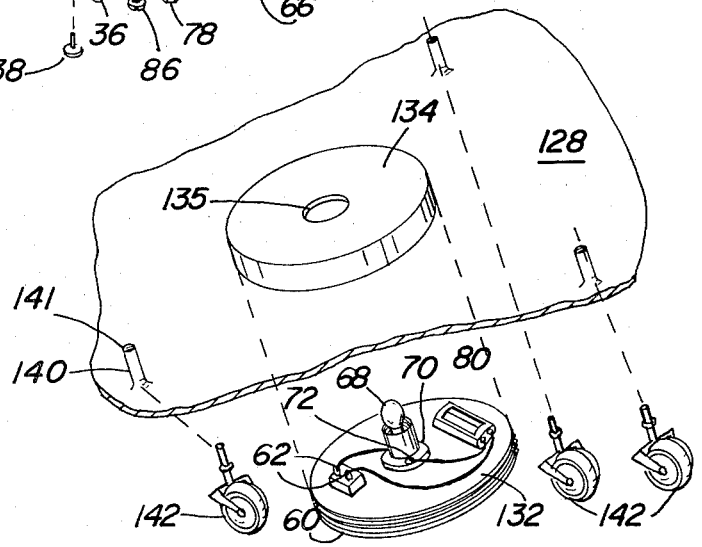
FIG. 2 illustrates a partial exploded view of a second embodiment of the present invention.

Referring now, to FIG. 2 wherein there is illustrated a second embodiment of the present invention. A bottom member 128 has at its center an inward projecting recess 134 with a threaded perimeter. A cover 132 has a threaded perimeter configured to threadingly engage the recess 134. A hand grip (not shown) is provided on a bottom wall of the cover for rotation. The cover 132 has assembled upon an upper surface the switch 60, the base 70, the bulb 68 and the battery holder 80 which are all interconnected in a manner similar to that described hereinabove for the same parts. An aperture 135 in the recess 134 allows the bulb 68 to project therethrough. A plurality of internally raised bosses 140 project inward from the bottom member 128. A plurality of bores 141 in the center of the bosses 140 pivotally receive a plurality of wheeled casters 142. The casters 142 support the bottom member 128 on a floor or surface and allow the toy to be moved along the surface in any direction. The bottom member 128 has along its perimeter a plurality of apertures 194 which align with the apertures 96 in the cover. A plurality of rivets 98 pass through the apertures 194 and the apertures 96 to affix the cover 128 to the rim 14.

The embodiments described hereinabove provide a toy with wheels that is movable along a supporting surface which flashes and glows in the dark to provide amusement for children.

Having thus described my invention what I claim is:

1. A flying saucer toy comprising:

a translucent circular plastic housing having a plurality of arcuate slits in an upper surface;

a colored transparent membrane covering the slits, and a blinking light source within the housing;

a cover of semi-rigid translucent plastic sheet having an outer rim extending horizontally outward around its periphery;

a lower housing integral with said outer rim curving upward and inward toward the center in an arcuate manner, terminating where the lower housing blends into an upper housing;

the upper housing integral with the lower housing curving upward and inward to form a hemisphere;

a first plurality of arcuate openings around the upper periphery of the lower housing spaced down a distance from the upper housing;

a second plurality of arcuate openings around the upper housing spaced up a distance from the lower housing;

a colored transparent membrane covering the first and second arcuate openings;

means for attaching the membrane to the space surrounding the openings;

a bottom member of semi-rigid plastic sheet having a shape complimentary to the outer rim, a circular slit at the center of the bottom member forming a cover, the slit ending short of a full circle to form a hinge joining the cover to the bottom member;

means for holding the cover closed;

an electrical switch having an open and closed position;

means for producing electrical energy, a flasher light bulb socket, and a light bulb attached to the cover, electrical conductors interconnecting the electrical energy means to the switch, the socket, and the bulb to cause the bulb to glow intermittently when the switch is closed;

a plurality of rotatable wheels for supporting the flying saucer on a surface, a plurality of openings in the bottom member through which the wheels project, means for attaching the wheels to the bottom member; and means for attaching the bottom member to the outer rim.

2. The flying saucer toy as defined in claim 1 wherein the means for attaching the membrane to the spaced surrounding the openings comprises a plurality of apertures around the perimeter of the openings, a plurality of apertures in the membrane aligned with the apertures in the perimeter, and a plurality of rivets passing through the perimeter apertures and the aligned apertures to secure the membrane in place.

3. The flying saucer toy as defined in claim 2 wherein the means for holding the cover closed comprises a cleat of plastic sheet pivotally riveted at one end to the bottom member near the edge of the cover opposite the hinge, pivoting the cleat over the cover holds the cover in place.

4. The flying saucer toy as defined in claim 3 wherein the electrical energy means is a battery.

5. The flying saucer toy as defined in claim 4 wherein the means for attaching the wheels to the bottom member comprises;

a pair of wheels spaced apart on the ends of an axle to align with the openings in the bottom member;

an axle support member having a half round groove corresponding to an axle diameter along a bottom wall, an aperture through the support member aligned with an aperture in the bottom member, a rivet passing through the support member and the bottom member to retain the axle within the groove and attach the support member to the bottom member.

* * * * *